US005584407A

United States Patent [19]

Kanjo

[11] Patent Number: 5,584,407

[45] Date of Patent: Dec. 17, 1996

[54] INTERLOCKING SLACKLESS DRAWBAR ASSEMBLY FOR RAILWAY FREIGHT CAR AND AN INTERLOCKING MECHANISM THEREFOR

[75] Inventor: Wajih Kanjo, Lockport, Ill.

[73] Assignee: Westinghouse Air Brake Company, Wilmerding, Pa.

[21] Appl. No.: 495,883

[22] Filed: Jun. 28, 1995

[51] Int. Cl.[6] ..... B61G 5/00

[52] U.S. Cl. ..... 213/75 R; 213/62 R; 213/188

[58] Field of Search ..... 213/50, 62 R, 213/75 R, 77, 80, 85, 96, 98, 182, 188; 105/4.1, 4.2; 280/492, 493, 494, 504, 514

[56] References Cited

U.S. PATENT DOCUMENTS

| | | | |
|---|---|---|---|
| 580,122 | 4/1897 | Carter | 213/188 |
| 1,557,060 | 10/1925 | Kadel | 213/67 A |
| 2,241,353 | 5/1941 | Kinne et al. | 213/72 |
| 2,334,034 | 11/1943 | Richards | 213/188 |
| 3,985,236 | 10/1976 | Martin | 213/75 R |
| 4,336,758 | 6/1982 | Radwill | 213/75 R |
| 4,531,648 | 7/1985 | Paton | 213/50 |
| 4,555,033 | 11/1985 | Miller | 213/57 |
| 4,580,686 | 4/1986 | Elliott | 213/62 |
| 4,700,853 | 10/1987 | Altherr et al. | 213/50 |
| 4,846,358 | 7/1989 | Rhen | 213/64 |
| 4,946,052 | 8/1990 | Kaim et al. | 213/75 R |
| 4,962,861 | 10/1990 | Wiebe | 213/75 R |
| 5,035,338 | 7/1991 | Kaufhold et al. | 213/50 |
| 5,201,827 | 4/1993 | Glover et al. | 213/50 |
| 5,232,106 | 8/1993 | Hawthorne et al. | 213/62 R |
| 5,271,511 | 12/1993 | Daugherty, Jr. et al. | 213/75 R |
| 5,360,125 | 11/1994 | Dawson et al. | 213/62 R |

*Primary Examiner*—S. Joseph Morano
*Attorney, Agent, or Firm*—James Ray & Associates

[57] ABSTRACT

An interlocking mechanism is positioned intermediate first and second end portions of a drawbar member portion of a slackless type drawbar assembly utilized in coupling adjacently disposed ends of a pair of railway freight cars together in a substantially semipermanent fashion. Such interlocking mechanism includes a first elongated member engageable at a first end thereof to an end of a first male connection member. A first at least one plate like member is disposed at a second end of the first elongated member of such interlocking mechanism. There is a first elongated slot formed through such first at least one plate like member. A second elongated member is engageable at a first end thereof to an end of a second male connection member. A second at least one plate like member is disposed at a second end of this second elongated member of such interlocking mechanism and a second elongated slot is formed through such second at least one plate like member which is positioned in alignment with such first elongated slot formed through the first at least one plate like member. There is a plate like connection member disposed in the first elongated slot formed through such first at least one plate like member and the second elongated slot formed through such second at least one plate like member for connecting such first elongated member of the interlocking mechanism to the second elongated member of such interlocking mechanism.

19 Claims, 3 Drawing Sheets

INTERLOCKING SLACKLESS DRAWBAR ASSEMBLY FOR RAILWAY FREIGHT CAR AND AN INTERLOCKING MECHANISM THEREFOR

FIELD OF THE INVENTION

The present invention relates, in general, to railway freight car slackless type drawbar assemblies which are utilized, in the railroad industry, to connect the adjacently disposed ends of a pair of such freight cars together in a substantially semipermanent fashion and, more particularly, the instant invention relates to an improved slackless type drawbar assembly for connecting together such adjacently disposed ends of such freight cars that will include an interlocking mechanism incorporated into the elongated drawbar member portion of such assembly which will enable such freight cars to be more easily and readily disconnected from and/or reconnected into a train consist and, still more particularly, this invention relates to an interlocking type mechanism which can easily be retrofitted into any of the slackless drawbar assemblies presently being used.

BACKGROUND OF THE INVENTION

Prior to the development of the present invention, slackless type drawbar assemblies have been utilized by the railroad industry for several years. Such slackless drawbar assemblies connect the adjacently disposed ends of a pair of railway freight cars together in a substantially semipermanent fashion. As is generally well recognized in the relevant freight car coupling art, these prior art slackless drawbar assemblies have been equipped with a one piece drawbar member as one of the necessary component parts thereof.

In these drawbar assemblies, such drawbar member is rotatably secured at each end thereof into the opening of the center sill portion of each of such pair of freight cars closely adjacent a respective end thereof. This will be the case, even though each of the several different manufacturers and/or suppliers of slackless drawbar assemblies will supply the railroad industry with their own particular design.

It is equally well recognized, in the railroad industry, that at least as many as five such freight cars may be interconnected using these slackless drawbar assemblies. Consequently, assuming for illustration purposes only that there are five such freight cars which have been interconnected in this manner, if only a single end of only a single one of the four such slackless drawbar assemblies required is in need of repair and/or maintenance, then all five of the freight cars must be removed from any revenue generating type service while such repair and/or maintenance is being performed.

Over the past several years, actual experience has rather conclusively demonstrated that these slackless drawbar assemblies will require relatively frequent maintenance. One of the primary reasons why they require a significant amount of costly maintenance is because the design of these prior art type drawbar assemblies inherently requires that a relatively large number of component parts be used.

Additionally, many of these component parts will at least include some surfaces which are frictionally engaged and which, also, must possess the capability of moving with respect to one another during in-track service. These frictionally engaged surfaces will include at least one concave and at least one convex shaped surface as well as a number of flat surfaces.

Furthermore, it is generally well recognized in the art that during service each of these frictionally engaged surfaces will be subjected to rather large forces being exerted on them while, at the same time, some relative movement is occurring between them. In the most extreme circumstances, the forces such frictionally engaged surfaces may be subjected to can be expected to exceed at least about one million pounds.

As would normally be expected, by those persons who are skilled in the mechanical art, the required relative movement between these frictionally engaged surfaces will generate a significant amount of heat energy. This is particularly the case when such frictionally engaged surfaces are being subjected to such extreme loads, which will significantly reduce the useful life span of these components.

Nevertheless, these slackless type drawbar assemblies, which are known to be in use at the present time, have generally provided the railroad industry with a much more modern style freight car coupling arrangement. For example, these slackless drawbar assemblies have substantially eliminated the requirement for a relatively expensive draft gear assembly as well as other freight car coupling components that were normally required before their introduction.

Furthermore, these slackless drawbar assemblies have generally resulted in an overall net decrease in the empty weight of such freight cars. This overall net weight reduction of such freight car is an extremely important factor to be taken into consideration by the user of such railway freight car in view of the ever rising energy cost.

It is believed to be equally well recognized, in the railroad industry, that these slackless drawbar assemblies are primarily installed on selected freight cars which will be utilized in a dedicated service type of application. The reason for this is that most of the freight cars that are utilized in this dedicated type service will not, as a general rule, require that they be uncoupled except for any routine maintenance and/or possible repair being required.

By way of example only, such freight cars which generally are used in such dedicated type service will at least include: coal cars, automobile and light truck transport cars and certain tank cars.

These slackless type drawbar assemblies have, nevertheless, gained a rather widespread acceptance in the railroad industry over the past several years in spite of the number of disadvantages which were discussed in some detail above. This would be expected, however, because there are a number of significant advantages that were gained by such railroad industry, in comparison to the older style standard type coupling arrangements which were and still are being used. Experience has demonstrated that these advantages far outweigh the disadvantages and such slackless drawbar assemblies have proven to the railroad industry over an extended period of time to be quite cost effective,

SUMMARY OF THE INVENTION

According to a first important aspect of the present invention, there is provided an interlocking type mechanism which is positioned intermediate the first end and the second end of the drawbar member portion of a slackless type drawbar assembly. These slackless type drawbar assemblies are utilized in coupling the adjacently disposed ends of a pair of railway freight cars together in a substantially semipermanent fashion. Such interlocking type mechanism includes a first elongated member portion which is engageable at a first end thereof to an end of a first male connection member.

A first at least one plate like member portion is disposed at a second end of such first elongated member portion of such interlocking type mechanism. There is a first elongated slot formed through such first at least one plate like member portion. This interlocking type mechanism further includes a second elongated member portion which is engageable at a first end thereof to an end of a second male connection member. A second at least one plate like member portion is disposed at a second end of the second elongated member portion of such interlocking type mechanism. Such second at least one plate like member portion has a second elongated slot formed therethrough which is positioned in alignment with the first elongated slot formed through such first at least one plate like member portion. A plate like connection means is disposed in the first elongated slot formed through such first at least one plate like member portion and the second elongated slot formed through such second at least one plate like member portion for connecting this first elongated member portion of such interlocking type mechanism to the second elongated member portion of such interlocking type mechanism.

In a second aspect, the present invention provides an improved slackless type drawbar assembly for connecting one end of a first railway type freight car to an adjacently disposed end of a second freight car in a substantially semipermanent fashion which has an interlocking type mechanism incorporated into the drawbar member portion of such drawbar assembly. This drawbar assembly includes a first female connection member having a first cavity formed therein. Such first female connection member is engageable in and securable to one end of a first center sill member disposed along a longitudinal centerline and beneath a first body portion of a first railway freight car. There is a second female connection member having a second cavity formed therein which faces such first cavity formed in the first female connection member. This second female connection member is engageable in and securable to one end of an adjacently disposed second center sill member disposed along a longitudinal centerline and beneath a second body portion of a second railway freight car. The slackless drawbar assembly further includes a first male connection member which has a first end thereof movably secured into such first cavity formed in the first female connection member. Such first male connection member has a first predetermined length. A second male connection member has a first end thereof movably secured into such second cavity formed in the second female connection member. This second male connection member has a second predetermined length. Another component of this slackless drawbar assembly is an interlocking mechanism. A first portion of such interlocking mechanism is connected at a first end thereof to an opposed second end of such first male connection member. This first portion of such interlocking mechanism includes a first at least one plate like member disposed at a second end thereof. Such first at least one plate like member having a first elongated slot formed therethrough. A second portion of such interlocking mechanism is connected at a first end thereof to an opposed second end of such second male connection member. Such second portion of the interlocking mechanism includes a second at least one plate like member disposed at a second end thereof. This second at least one plate like member having a second elongated slot formed therethrough which is aligned with the first elongated slot formed through such first at least one plate like member. There is a third portion of such interlocking mechanism disposed in the first elongated slot formed through such first at least one plate like member and the second elongated slot formed through such second at least one plate like member for connecting such first portion of the interlocking mechanism to such second portion of the interlocking mechanism and thereby form such improved slackless type drawbar assembly.

OBJECTS OF THE INVENTION

It is, therefore, one of the primary objects of the present invention to provide an interlocking mechanism disposed in a drawbar member portion of a slackless drawbar assembly which will enable such drawbar assembly to be more readily connected and/or disconnected when required.

Another object of the present invention is to provide an interlocking mechanism disposed in a drawbar member portion of a slackless drawbar assembly which will substantially minimize the downtime of a railway freight car for repairs and maintenance.

Still another object of the present invention is to provide an interlocking mechanism disposed in a drawbar member portion of a slackless drawbar assembly which can be relatively easily retrofitted into existing drawbar member portions of existing slackless drawbar assemblies.

Yet another object of the present invention is to provide an interlocking mechanism disposed in a drawbar member portion of a slackless drawbar assembly which is relatively simple in design.

A further object of the present invention is to provide an interlocking mechanism disposed in a drawbar member portion of a slackless drawbar assembly which can be used with either a rotary or non-rotary type drawbar assembly.

It is an additional object of the present invention to provide an interlocking mechanism disposed in a drawbar member portion of a slackless drawbar assembly which will enable a single freight car requiring repair to be removed from service.

Still yet another object of the present invention is to provide an interlocking mechanism disposed in a drawbar member portion of a slackless drawbar assembly which will enable the user to mix and/or match different manufacturers slackless drawbar assemblies in a unit train.

Yet still another object of the present invention is to provide an interlocking mechanism disposed in a drawbar member portion of a slackless drawbar assembly which is cost effective for the end user when compared to the presently used slackless drawbar assemblies.

A still further object of the present invention is to provide a slackless drawbar assembly for connecting the adjacently disposed ends of a pair of railway freight cars together in a substantially semipermanent fashion which includes an interlocking mechanism disposed in the drawbar member portion of such slackless drawbar assembly.

An additional object of the present invention is to provide a slackless drawbar assembly for connecting the adjacently disposed ends of a pair of railway freight cars together in a substantially semipermanent fashion which includes an interlocking mechanism disposed in the drawbar portion of such slackless drawbar assembly that can be retrofitted onto existing freight cars.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing Figures and with the appended claims.

Figure 1:
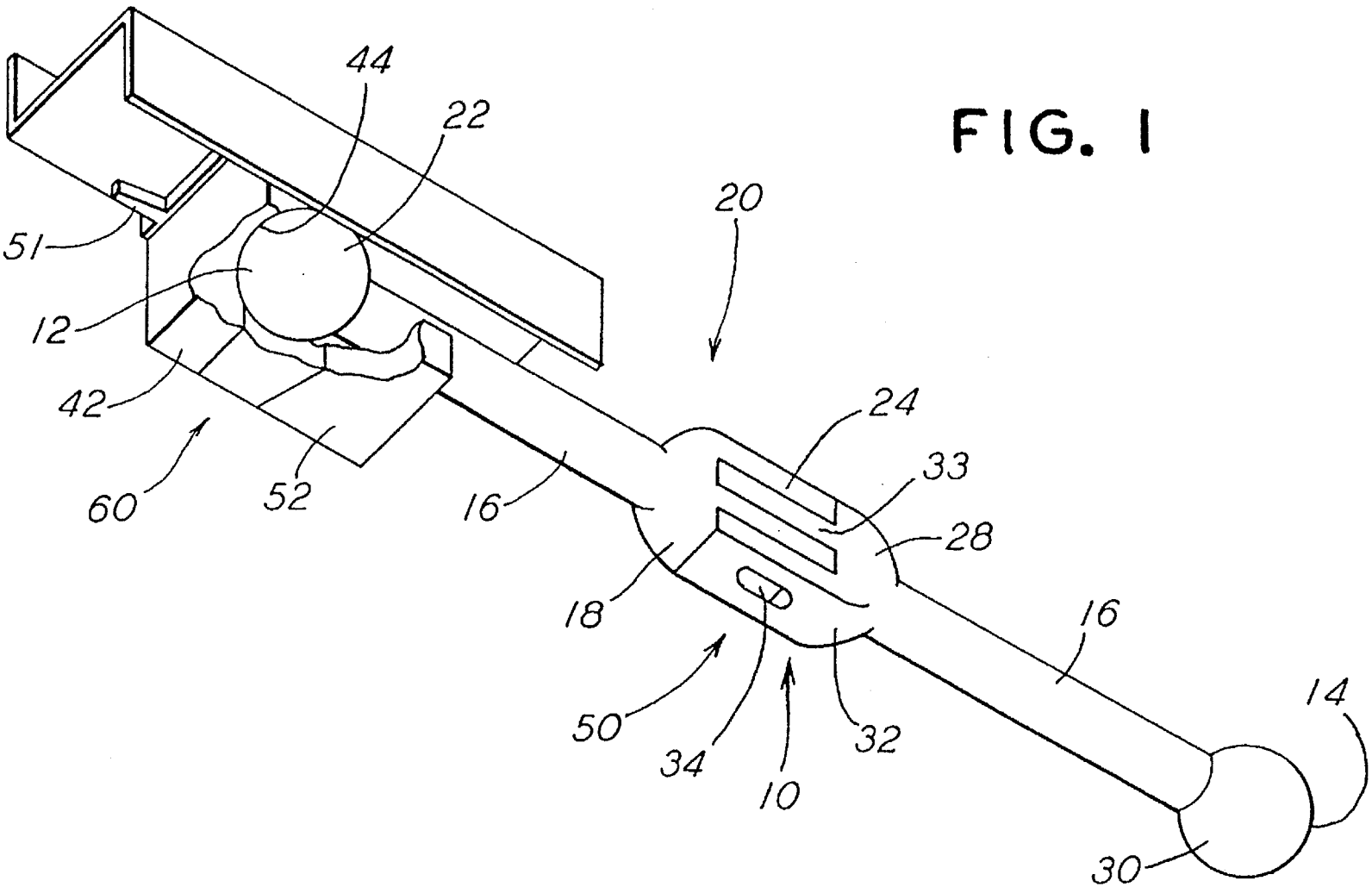
FIG. 1 is a perspective view which illustrates one presently preferred arrangement of a female connection member, with a portion being cut away, disposed at one end of a slackless type drawbar assembly equipped with the interlocking type mechanism of the instant invention.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing Figures, for the sake of clarity and understanding of the invention.

It should be further noted here, applicants would expect that essentially all of the advantages provided by the interlocking mechanism of the present invention could be easily achieved by simply incorporating the interlocking mechanism of the present invention into virtually any one of the presently known slackless type drawbar assemblies which are in use in the railroad industry at the present time. Accordingly, even though such interlocking mechanism will be described hereinafter in conjunction with one specific embodiment of a slackless drawbar assembly it is not to be limited either thereto or thereby.

Now reference is made, more particularly, to the several Figures illustrated in the drawings. Shown therein is a presently preferred embodiment of an interlocking mechanism, generally designated 10. Such interlocking mechanism 10 is positioned intermediate axially opposed first and second outermost end portions 12 and 14, respectively, of a drawbar member portion 16 of a slackless type drawbar assembly, generally designated 20. As is generally well known in the railway coupling art, such slackless drawbar assembly 20 is utilized in coupling the adjacently disposed ends (not shown) of a pair of railway type freight cars (not shown) together in a substantially semipermanent fashion.

Such interlocking mechanism 10 includes a first elongated member portion 18 engageable at a first end thereof to an end of a first male connection member 22. There is a first at least one plate like member portion 24 disposed at a second end of such first elongated member portion 18 of the interlocking mechanism 10. In addition, a first elongated slot 26 is formed through this first at least one plate like member portion 24.

When such interlocking mechanism 10 is to be incorporated into an existing slackless type drawbar assembly (not shown), a middle section of the drawbar member portion (not shown) of such drawbar assembly will be removed. Obviously, such drawbar member portion is now in two pieces and the first end of such first male connection member 22 will be secured to an end of a first piece of the drawbar member portion.

On the other hand, if a new slackless type drawbar assembly 20 is being provided, it is presently preferred that such first elongated member portion 18 be formed as an integral single piece with such end of the first male connection member 22.

In the more presently preferred embodiment of the invention, such interlocking mechanism 10 will include at least two plate like member portions 24 and 25 disposed at the second end of such first elongated member portion 18 and each of such at least two plate like member portions 24 and 25 will include an elongated slot 26 and 27, respectively, formed therethrough. An inner surface 29 of a first one 24 of the at least two plate like member portions 24 and 25 being disposed substantially parallel to a confronting inner surface 31 of the second one 25 of these at least two plate like member portions 24 and 25.

According to this embodiment of the invention, a second elongated member portion 28 is engageable at a first end thereof to an end of a second male connection member 30. There is, also, a second at least one plate like member portion 32 disposed at a second end of such second elongated member portion 28 of such interlocking mechanism 10. Further, a second elongated slot 34 is formed through the second at least one plate like member portion 32 which is positioned substantially in alignment with the first elongated slot 26 formed through such first at least one plate like member portion 24.

As discussed above, when such interlocking mechanism 10 is to be added to an existing slackless drawbar assembly and the middle section of the drawbar member portion of such drawbar assembly has been removed the first end of such second male connection member 30 will be secured to an end of a second piece of such drawbar member portion.

However, when a new slackless drawbar assembly 20 is being provided, it is, likewise, presently preferred that such second elongated member portion 28 be formed as an integral single piece with such end of the second male connection member 30.

It is further presently preferred that each of such first elongated slot 26 formed through the first at least one plate like member portion 24 and such second elongated slot 34 formed through the at least one second plate like member portion 32 will be substantially rectangular in shape.

Such interlocking mechanism 10 for the slackless drawbar assembly 20, according to the presently preferred embodiment of the invention, will further include at least two plate like member portions 32 and 33 disposed at the second end of such second elongated member portion 28 and each of such at least two plate like member portions 32 and 33 include an elongated slot 34 and 35, respectively, formed therethrough. An inner surface 37 of a first one 32 of these at least two plate like member portions 32 and 33 being disposed substantially parallel to a confronting inner surface 39 of a second one 33 of such at least two plate like member portions 32 and 33.

Preferably, each one of such at least two elongated slots 26 and 27 which are formed, respectively, through the at least two plate like member portions 24 and 25 disposed at the second end of the first elongated member portion 18 and such at least two elongated slots 34 and 35 which are formed, respectively, through such at least two plate like member portions 32 and 33 disposed at the second end of such second elongated member portion 28 will be substantially rectangular in shape.

The final essential component part of such interlocking mechanism 10 is at least one plate like connection means, generally designated 40. Such at least one plate like connection means 40 is disposed in such first elongated slot 26 formed through the first at least one plate like member portion 24 and such second elongated slot 34 formed through the second at least one plate like member portion 32. In this manner, such first elongated member portion 18 of such interlocking mechanism 10 is connected in a slackless fashion to the second elongated member portion 28 of the interlocking mechanism 10.

According to a presently preferred embodiment of such interlocking mechanism 10, such plate like connection means 40 which is disposed in such first elongated slot 26 formed through the first at least one plate like member portion 24 and such second elongated slot 34 formed through the second at least one plate like member portion 32 will be a pair of wedge shaped plate like members 36 and 38.

In this embodiment of such interlocking mechanism 10 for a slackless drawbar assembly 20, the interlocking mechanism 10 will further include a retaining means, generally designated 50. Such retaining means 50 is engageable with each of such first at least one plate like member portion 24 and the second at least one plate like member portion 32 and such pair of wedge shaped plate like members 36 and 38 for retaining the pair of wedge shaped plate like members 36 and 38 in the first elongated slot 26 formed through the first at least one plate like member portion 24 and such second elongated slot 34 formed through such second at least one plate like member portion 32. Such retaining means 50 can include any one or more of at least one of a weldment, a clamp, a bolt and a friction fit. The most presently preferred retaining means 50 is the friction fit.

According to another aspect, the present invention provides an improved slackless type drawbar assembly, generally designated 20. This slackless drawbar assembly 20 is utilized in coupling one end (not shown) of a first railway type freight car (not shown) together with an adjacently disposed end (not shown) of a second freight car (not shown) in a substantially semipermanent fashion. This slackless drawbar assembly 20 has an interlocking type mechanism, generally designated 10, incorporated into a drawbar member portion 16 of such slackless drawbar assembly 20.

This improved slackless type drawbar assembly 20 includes a first female connection member, generally designated 60. The first female connection member 60 has a first cavity formed therein. Such first female connection member 60 is engageable in and securable to a predetermined end of a first center sill member disposed substantially along a longitudinal centerline and beneath a first body portion (not shown) of a first railway freight car (not shown).

Figure 2:
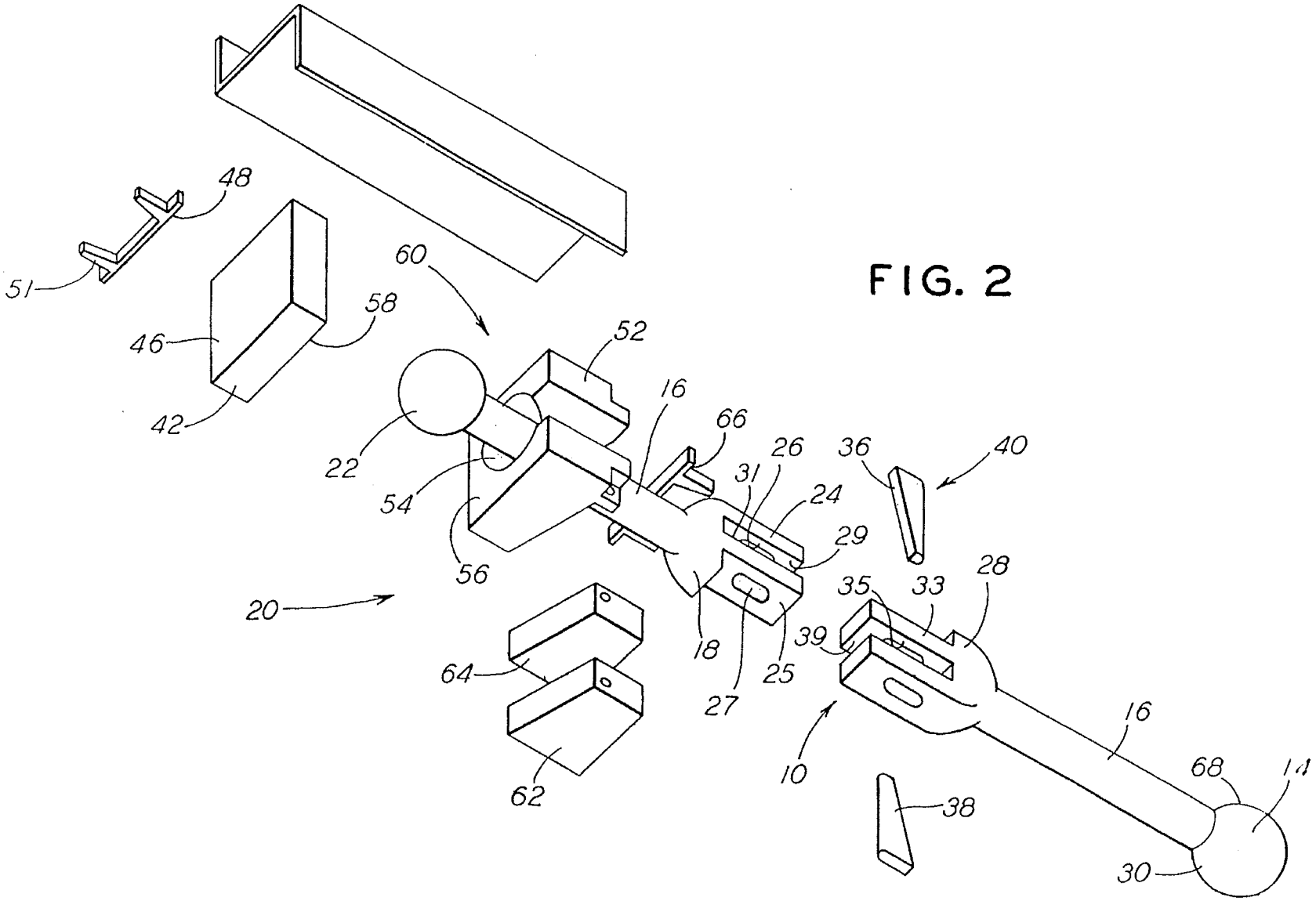
FIG. 2 is an exploded view, in perspective of the slackless type drawbar assembly equipped with the interlocking type mechanism of the instant invention which was illustrated in FIG. 1.
Figure 3:
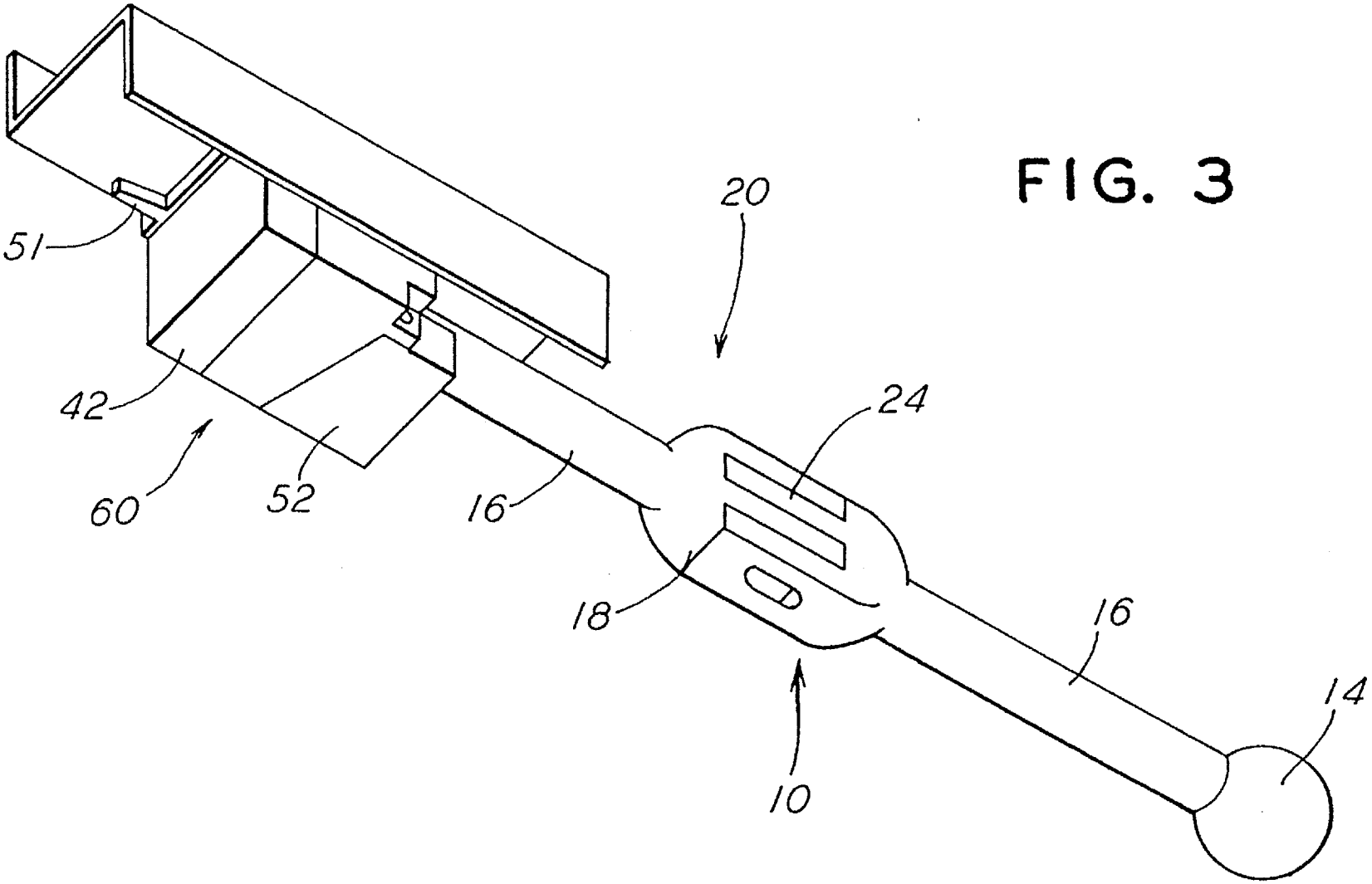
FIG. 3 is a perspective view, similar to FIG. 1 but without any portion of the female connection member being cut away, which illustrates one presently preferred arrangement of such female connection member disposed at one end of a slackless type drawbar assembly equipped with the interlocking type mechanism of the instant invention.

In the embodiment of the invention illustrated in FIGS. 1 through 3, such slackless drawbar assembly 20 includes a rotary type connection at each end thereof. Accordingly, such first female connection member 60 includes a rear bearing block member 42 having a first portion 44 of such first cavity formed therein. At least a portion of a rear surface 46 of this rear bearing block member 42 abuts a front surface portion 48 of a rear draft stop member 51. Such rear draft stop member 51 which is secured to the center sill member will prevent substantially any longitudinal movement of such slackless drawbar assembly 20 in a first longitudinal direction during operation. In this embodiment, the first female connection member 60 further includes a front bearing block member 52 having a second portion 54 of such first cavity formed therein. Such second portion 54 of the first cavity faces the first portion 44 of such first cavity. The rear surface 56 of the front bearing block member 52 is positioned to abuttingly engage the front surface 58 of the rear bearing block member 42. Only one such front surface 58 and rear bearing block member 42 being shown in the drawings. A pair of wedge members 62 and 64 are disposed intermediate front bearing block member 52 and a front draft stop member 66. There is only one front draft stop member 66 illustrated in the drawing Figures, for the sake of clarity. Such front draft stop member 66, like the rear draft stop member 51, is secured to the center sill member and prevents substantially any longitudinal movement of such slackless drawbar assembly 20 in a second longitudinally opposed direction during operation.

A second female connection member (not shown), having a second cavity (not shown) formed therein which faces such first cavity formed in said first female connection member 60, is provided radially opposite such first female connection member 60. Such second female connection member is engageable in and securable to a predetermined end (not shown) of an adjacently disposed second center sill member (not shown) disposed along a longitudinal centerline and beneath a second body portion (not shown) of a second railway freight car (not shown). This second female connection member, in the presently preferred embodiment of the invention, is substantially a mirror image of such first female connection member 60 and, therefore, has not been illustrated in the drawings.

Slackless drawbar assembly 20 includes a first male connection member 22 having a first end 23 thereof movably secured within such first cavity formed in the first female connection member 60. The first male connection member 22 is provided with a first predetermined length.

Additionally, such slackless drawbar assembly 20 includes a second male connection member 30 which will have a first end 68 thereof movably secured within the second cavity formed in such second female connection member. This second male connection member 30 is provided with a second predetermined length. In the presently preferred embodiment of the invention, the first predetermined length of such first male connection member 22 will be substantially identical to the second predetermined length of the second male connection member 30. In this manner, the positioning of such interlocking type mechanism 10 substantially midway between an outermost end portion 12 of such first end of the first male connection member 22 and an outermost end portion 14 of such first end of such second male connection member 30 can be achieved.

Depending upon the end use of a particular railway freight car, such improved slackless type drawbar assembly 20 may be equipped such that at least one of such first end of the first male connection member 22 and such first end of the second male connection member 30 is of the rotary type.

It is also within the scope of the present invention for each of such first end of this first male connection member 22 and such first end of the second male connection member 30 to be of the rotary type. Such rotary type ends are the type of ends which have been illustrated in the drawings.

Likewise, it is within the scope of the present invention for such improved slackless type drawbar assembly 20 to have at least one of such first end of the first male connection member 22 and such first end of the second male connection member 30 to be of the non-rotary type (not shown).

Once again, depending upon the type of freight car such improved slackless type drawbar assembly 20 is to be installed on, it is possible for each of such first end of the first male connection member 22 and the first end of such second male connection member 30 to be of the non-rotary type and this arrangement is within the scope of the appended claims.

In addition, such improved slackless type drawbar assembly 20 may include one of such first end of the first male connection member 22 and the first end of such second male connection member 30 of the rotary type and an axially opposed one of such first end of the first male connection member 22 and such first end of the second male connection member 30 of the non-rotary type.

A first portion of an interlocking type mechanism 10, of such slackless drawbar assembly 20, is connected at a first end thereof to an opposed second end of such first male connection member 22. This first portion of such interlocking type mechanism 10 includes a first at least one plate like member 24 disposed at a second end thereof. Such first at least one plate like member 24 includes a first elongated slot 26 formed therethrough.

There is, also a second portion of such interlocking type mechanism 10 connected at a first end thereof to an opposed second end of such second male connection member 30. The second portion of such interlocking type mechanism 10 includes a second at least one plate like member 32 disposed at a second end thereof. Such second at least one plate like member 32 includes a second elongated slot 34 formed therethrough. This second elongated slot 34 is aligned with the first elongated slot 26 formed through such first at least one plate like member 24.

In addition, a third portion, generally designated 40, of such interlocking type mechanism 10 is disposed in such first elongated slot 26 formed through the first at least one plate like member 24 and such second elongated slot 34 formed through such second at least one plate like member 32 for connecting the first portion of the interlocking type mechanism 10 to such second portion of the interlocking type mechanism 10 thereby forming such improved slackless type drawbar assembly 20.

In the presently preferred embodiment of the improved slackless type drawbar assembly 20, such interlocking type mechanism 10 includes at least two plate like members 24,25 and 32,33 disposed, respectively, at such second end of at least one of such first portion and such second portion thereof. Each of such at least two plate like members 24,25 and 32,33 includes an elongated slot formed therethrough. In the most preferred embodiment, such interlocking type mechanism 10 will include at least two plate like members 24,25 and 32,33 disposed, respectively, at the second end of each of such first portion and such second portion thereof and each of such at least two plate like members 24,25 and 32,33 will include an elongated slot formed therethrough.

Lastly, in the presently preferred arrangement of the improved slackless type drawbar assembly 20, such interlocking type mechanism 10 further includes a retaining means, generally designated 50. Such retaining means 50 is engageable with each of such first at least one plate like member 24 and such second at least one plate like member 32 and the third portion of such interlocking type mechanism 10 for retaining such third portion in the first elongated slot 26 formed through such first at least one plate like member 24 and such second elongated slot 34 formed through such second at least one plate like member 32. The presently preferred retaining means 50 includes a pair of wedge shaped members 36 and 38.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit or the scope of the appended claims.

We claim:

1. An interlocking type mechanism positioned intermediate first and second end portions of a drawbar member portion of a slackless type drawbar assembly which is utilized in coupling adjacently disposed ends of a pair of railway type freight cars together in a substantially semi-permanent fashion, said interlocking type mechanism comprising:

(a) a first elongated member portion engageable at a first end thereof to an end of a first male connection member;

(b) a first at least one plate like member portion disposed at a second end of said first elongated member portion of said interlocking mechanism;

(c) a first elongated slot formed through said first at least one plate like member portion;

(d) a second elongated member portion engageable at a first end thereof to an end of a second male connection member;

(e) a second at least one plate like member portion disposed at a second end of said second elongated member portion of said interlocking mechanism;

(f) a second elongated slot formed through said second at least one plate like member portion which is positioned substantially in alignment with said first elongated slot formed through said first at least one plate like member portion when said first at least one plate like member portion and said second at least one plate like member portion intermesh and said first elongated member portion and said second elongated member portion share a longitudinal axis; and (g) a plate like connection means disposed in each of said first elongated slot formed through said first at least one plate like member portion and said second elongated slot formed through said second at least one plate like member portion for connecting said first elongated member portion of said interlocking mechanism to said second elongated member portion of said interlocking mechanism in a slackless manner.

2. An interlocking mechanism for a slackless drawbar assembly, according to claim 1, wherein said first elongated member portion is formed as an integral single piece with said end of said first male connection member.

3. An interlocking mechanism for a slackless drawbar assembly, according to claim 2, wherein said second elongated member portion is formed as an integral single piece with said end of said second male connection member.

4. An interlocking mechanism for a slackless drawbar assembly, according to claim 3, wherein said first elongated slot formed through said first at least one plate like member portion and said second elongated slot formed through said second at least one plate like member portion are substantially rectangular in shape.

5. An interlocking mechanism for a slackless drawbar assembly, according to claim 1, wherein said first at least one plate like member portion includes at least two plate like members disposed at said second end of said first elongated member portion and each of said at least two plate like members include said first elongated slot formed therethrough, an inner surface of a first of said at least two plate like members being disposed substantially parallel to a confronting inner surface of a second one of said at least two plate like members.

6. An interlocking mechanism for a slackless drawbar assembly, according to claim 5, wherein said second at least one plate like member portion includes at least two plate like members disposed at said second end of said second elongated member portion and each of said at least two plate like members include said second elongated slot formed therethrough, an inner surface of a first of said at least two plate like members being disposed substantially parallel to a confronting inner surface of a second one of said at least two plate like members and wherein said first at least one plate like member portion and said second at least one plate like member portion intermesh such that outer surfaces of said second ends of said first and said second elongated member portions are flush.

7. An interlocking mechanism for a slackless drawbar assembly, according to claim 6, wherein each of said at least two elongated slots formed through said at least two plate like members disposed at said second end of said first elongated member portion and said at least two elongated slots formed through said at least two plate like members disposed at said second end of said second elongated member portion are substantially rectangular in shape.

8. An interlocking mechanism for a slackless drawbar assembly, according to claim 1, wherein said plate like connection means disposed in said first elongated slot formed through said first at least one plate like member portion and said second elongated slot formed through said second at least one plate like member portion is a pair of wedge shaped plate like members.

9. An interlocking mechanism for a slackless drawbar assembly, according to claim 8, wherein said interlocking mechanism further includes a retaining means engageable with each of said first at least one plate like member portion and said second at least one plate like member portion and said pair of wedge shaped plate like members for retaining said pair of wedge shaped plate like members in said first elongated slot formed through said first at least one plate like member portion and said second elongated slot formed through said second at least one plate like member portion.

10. An improved slackless type drawbar assembly utilized in coupling one end of a first railway type freight car together with an adjacently disposed end of a second railway type freight car in a substantially semipermanent fashion which has an interlocking type mechanism incorporated into a drawbar member portion of such slackless type drawbar assembly, said improved slackless type drawbar assembly comprising:

(a) a first female connection member, having a first cavity formed therein, engageable in and securable to a predetermined end of a first center sill member disposed substantially along a longitudinal centerline and beneath a first body portion of such first railway freight car;

(b) a second female connection member, having a second cavity formed therein which faces said first cavity formed in said first female connection member, engageable in and securable to a predetermined end of an adjacently disposed second center sill member disposed substantially along a longitudinal centerline and beneath a second body portion of such second railway freight car;

(c) a first male connection member having a first end thereof movably secured within said first cavity formed in said first female connection member, said first male connection member having a first predetermined length;

(d) a second male connection member having a first end thereof movably secured within said second cavity formed in said second female connection member, said second male connection member having a second predetermined length;

(e) a first portion of said interlocking mechanism connected at a first end thereof to an opposed second end of said first male connection member, said first portion of said interlocking mechanism having a first at least one plate like member portion disposed at a second end thereof, said first at least one plate like member portion having a first elongated slot formed therethrough;

(f) a second portion of said interlocking mechanism connected at a first end thereof to an opposed second end of said second male connection member, said second portion of said interlocking mechanism having a second at least one plate like member portion disposed at a second end thereof, said second at least one plate like member portion having a second elongated slot formed therethrough which is substantially aligned with said first elongated slot formed through said first at least one plate like member portion when said first at least one plate like member portion and said second at least one plate like member portion intermesh and said first male connection member and said second male connection member share a longitudinal axis; and (g) a third portion of said interlocking mechanism disposed in said first elongated slot formed through said first at least one plate like member portion and said second elongated slot formed through said second at least one plate like member portion for connecting said first portion of said interlocking mechanism to said second portion of said interlocking mechanism, thereby forming a slackless connection and providing said improved slackless type drawbar assembly wherein said first at least one plate like member portion and said second at least one plate like member portion intermesh such that outer surfaces of said second ends of said first portion and said second portion are flush.

11. An improved slackless type drawbar assembly, according to claim 10, wherein at least one of said first end of said first male connection member and said first end of said second male connection member includes a rotary type end.

12. An improved slackless type drawbar assembly, according to claim 11, wherein each of said first end of said first male connection member and said first end of said second male connection member includes said rotary type end.

13. An improved slackless type drawbar assembly, according to claim 10, wherein at least one of said first end of said first male connection member and said first end of said second male connection member includes a non-rotary type end.

14. An improved slackless type drawbar assembly, according to claim 13, wherein each of said first end of said first male connection member and said first end of said second male connection member includes said non-rotary type end.

15. An improved slackless type drawbar assembly, according to claim 10, wherein one of said first end of said first male connection member and said first end of said second male connection member includes a rotary type end and an axially opposed one of said first end of said first male connection member and said first end of said second male connection member includes a non-rotary type end.

16. An improved slackless type drawbar assembly, according to claim 10, wherein said first predetermined length of said first male connection member is substantially identical to said second predetermined length of said second male connection member thereby positioning said interlocking mechanism substantially midway between an outermost end surface of said first end of said first male connection member and an outermost end surface of said first end of said second male connection member.

17. An improved slackless type drawbar assembly, according to claim 10, wherein said first at least one plate like member portion includes at least two plate like members disposed at said second end of at least one of said first portion and said second portion thereof and each of said at least two plate like members includes said first elongated slot formed therethrough, an inner surface of a first of said at least two plate like members being disposed substantially parallel to a confronting inner surface of a second one of said at least two plate like members.

18. An improved slackless type drawbar assembly, according to claim 17, wherein said second at least one plate like member portion includes at least two plate like members disposed at said second end of each of said first portion and said second portion thereof and each of said at least two plate like members includes said second elongated slot formed therethrough, an inner surface of a first of said at least two plate like members being disposed substantially parallel to a confronting inner surface of a second one of said at least two plate like members.

19. An improved slackless type drawbar assembly, according to claim 10, wherein said interlocking mechanism further includes a retaining means engageable with each of said first at least one plate like member portion and said second at least one plate like member portion and said third portion of said interlocking mechanism for retaining said third portion in said first elongated slot formed through said first at least one plate like member portion and said second elongated slot formed through said second at least one plate like member portion.

* * * * *

UNITED STATES PATENT AND TRADEMARK OFFICE

CERTIFICATE OF CORRECTION

PATENT NO. : 5,584,407

DATED : December 17, 1996

INVENTOR(S) : Wajih Kanjo

It is certified that error appears in the above-identified patent and that said Letters Patent is hereby corrected as shown below:

Column 2, line 54, please delete "," and insert --.--.

Signed and Sealed this

Fourteenth Day of July, 1998

Bruce Lehman

*Attest:*

BRUCE LEHMAN

*Attesting Officer*

*Commissioner of Patents and Trademarks*